US006158615A

United States Patent [19]

Hill

[11] Patent Number: 6,158,615

[45] Date of Patent: Dec. 12, 2000

[54] WALL-MOUNTED DISPENSER FOR PACKAGES OF CIGARETTES

[76] Inventor: Curtis R. Hill, 310 Petersburg Rd., Powhatan, Va. 23139

[21] Appl. No.: 09/320,737

[22] Filed: May 27, 1999

[51] Int. Cl.[7] ..... A47F 1/04

[52] U.S. Cl. ..... 221/154; 221/197

[58] Field of Search ..... 221/107, 111, 221/197, 154, 287, 160, 163; 271/207, 163; 312/42

[56] References Cited

U.S. PATENT DOCUMENTS

| | | | |
|---|---|---|---|
| D. 249,764 | 10/1978 | Burklacich | D6/130 |
| 4,130,326 | 12/1978 | Hornblad | 312/292 |
| 4,720,092 | 1/1988 | Juleff | 221/197 |
| 4,850,511 | 7/1989 | Kral et al. | 221/154 |
| 5,167,345 | 12/1992 | Bleeker | 221/17 |
| 5,269,597 | 12/1993 | Yenglin et al. | 312/42 |
| 5,351,854 | 10/1994 | Hagopian | 221/107 |
| 5,397,016 | 3/1995 | Torrence et al. | 221/11 |
| 5,407,094 | 4/1995 | Vajtay | 221/193 |
| 5,647,507 | 7/1997 | Kasper | 221/197 |

*Primary Examiner*—Kenneth W. Noland
*Attorney, Agent, or Firm*—Norman B. Rainer

[57] ABSTRACT

A wall-mountable apparatus for securably dispensing packages of cigarettes includes a vertically elongated interior casing, and an exterior shell configured to embrace the interior casing and pivotally jointed thereto in a manner to permit swinging movement of the shell in a vertical path between a lockable upper position which encloses the interior casing, and a lower position which exposes the interior casing. A basket tray disposed within the interior casing holds a multitude of vertically stacked packages of cigarettes which descend by gravity effect to a serving panel which may be adjustably disposed in a lower, dispensing position or in an upraised, non-dispensing and locked position.

10 Claims, 2 Drawing Sheets

WALL-MOUNTED DISPENSER FOR PACKAGES OF CIGARETTES

BACKGROUND OF THE INVENTION

1. Field of the Invention

This invention concerns a dispenser for vertically stacked uniformly sized packages, and more particularly relates to a lockable wall-mounted dispenser for packages of cigarettes.

2. Description of the Prior Art

Vending machines for packages of cigarettes are well known. As disclosed in U.S. Pat. Nos. 4,130,326; 5,351,854; 5,397,016; 5,407,094 and elsewhere, such machines comprise a locked chamber for holding a multitude of cigarette packages in a stacked array, means for receiving payment, and means for sequentially dispensing the packages, usually by a gravity fall technique.

Adults who enjoy cigarette smoking often do not want their children to take up the cigarette-smoking pastime. In the home environment therefore, the smoking adults would like to have ready access to packages, but would prefer to deny such access to their children or other unauthorized persons.

U.S. Pat. No. D 249,764 to Burklacish discloses a wall-mounted dispenser for vertically stacked packages of cigarettes. Although well suited for use in a residential dwelling, the Burklacish dispenser has no provision for preventing unauthorized removal of packages.

It is accordingly an object of the present invention to provide wall-mounted apparatus for the storage and dispensing of packages of cigarettes.

It is a further object of this invention to provide apparatus as in the foregoing object which can be secured with respect to unauthorized dispensation.

It is another object of the present invention to provide apparatus of the aforesaid nature which is easy to use and of durable simple construction amenable to low cost manufacture.

These objects and other objects and advantages of the invention will be apparent from the following description.

SUMMARY OF THE INVENTION

The above and other beneficial objects and advantages are accomplished in accordance with the present invention by a wall-mountable apparatus for securably dispensing packages of cigarettes, said apparatus comprising:

1) a vertically elongated interior casing comprised of a top portion, opposed side panels and a flat rear panel having means for attachment to a vertical wall,
2) an exterior shell comprised of a sidewall panel having a front portion, a horizontally disposed lower edge, vertically disposed rear edges, an upper panel portion, and a vertical slot in said front portion that opens onto said lower edge, said exterior shell configured to embrace said interior casing and joined thereto by way of pivot means which permit swinging movement of said exterior shell in a vertical path between an upper position which encloses said interior casing and a lower position which exposes said interior casing,
3) a basket tray disposed within said interior casing and adapted to hold a vertically stacked multitude of packages of cigarettes, said basket tray comprised of opposed vertical retaining walls, an upper extremity having a horizontally disposed abutment panel, and a lower extremity having a horizontally disposed serving panel,
4) means for permitting reciprocal vertical movement of said basket tray between a dispensing lower state wherein said serving panel is disposed below the lower edge of said exterior shell to a sufficient extent to permit removal of a package of cigarettes from said basket tray, and a locked upper state wherein said serving panel is spaced too close to said lower edge to permit removal of a package of cigarettes from said basket tray,
5) first locking means for preventing unauthorized movement of said basket tray to its dispensing state, and
6) second locking means for securing said exterior shell in said upper position.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
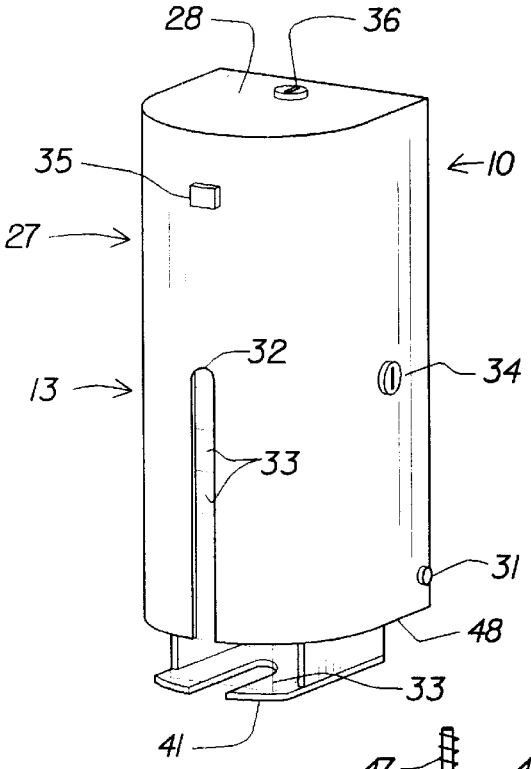
FIG. 1 is a front and side perspective view of an embodiment of the dispenser of the present invention shown in its dispensing state.

Referring now to FIGS. 1–6, an embodiment of the dispensing device 10 of the present invention is shown comprised of interior casing 12, exterior shell 13 adapted to pivotally embrace said interior casing, and basket tray 14 adapted to reside within said interior casing.

Interior casing 12 is vertically elongated between upper and lower extremities 15 and 16, respectively, and is further comprised of top portion 17, left and right side panels 18 and 19, respectively, having interior and exterior surfaces 54 and 55, respectively, and flat rear panel 20 equipped with keyhole-type apertures 21 to facilitate mounting to a vertical wall surface. At least two of said apertures are employed in symmetric disposition with respect to a center vertical plane of symmetry 69. Said interior casing is preferably fabricated of plastic, and may be of monolithic construction by virtue of a molding operation. One of said side panels, such as right side panel 19, may be provided with an arcuate slot 22 to accommodate a locking mechanism associated with exterior shell 13, as will be described.

Lower extremity 16 of said interior casing is provided with opposed horizontal lower abutment shelves 23 inwardly directed with respect to the interior region of said casing. The top portion 17 of said interior casing is provided with a vertically oriented control panel 24 extending between said side panels in parallel relationship to rear panel 20, and opposed horizontal retaining shelves 25 attached to said side panels. Opposed horizontal upper abutment shelves 53 are secured to interior surfaces 54 at equal distances below shelves 25.

Figure 2:
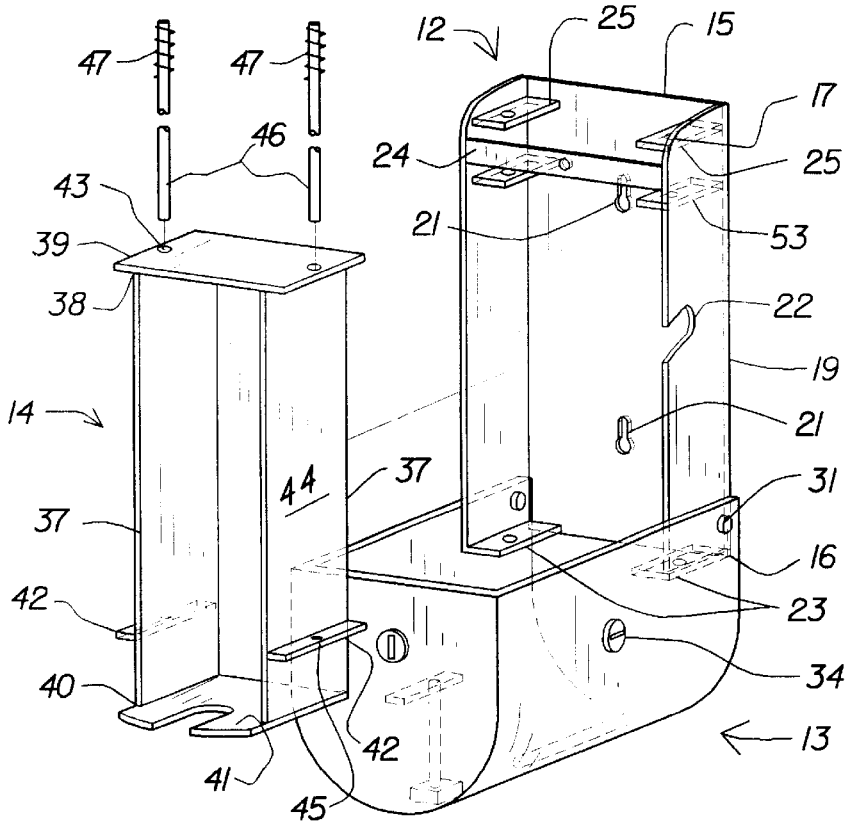
FIG. 2 is an exploded perspective view of the embodiment of FIG. 1.

Said exterior shell is comprised of a sidewall panel 27 shown to be of arcuate curved contour having a front portion 50, left and right side portions 29 and 30, respectively, which terminate downwardly in horizontally disposed lower edge 48, and flat upper panel 28. Front portion 50 is shown to be convex outwardly with respect to interior casing 12. Said exterior shell is configured to embrace said interior casing, and is attached thereto by pivot means in the form of rivet pins 31. Such manner of attachment enables said exterior shell to have swinging movement in a vertical path between an upper position, as shown in FIG. 1, which encloses said interior casing, and a lower position, as shown in FIG. 2, which exposes said interior casing. Front portion 50 of said exterior shell is preferably provided with a centered vertical slot 32 which permits the viewing of individual packages of cigarettes 33 held within the dispenser apparatus. A lock 34 is associated with right side panel 30 and adapted to ride within arcuate slot 22 of interior casing 12, whereby locked engagement between said exterior shell and interior casing is secured. A push-button 35 is associated with front portion 50 above slot 32, said button being a component of first locking means 51, as will be detailed hereinafter. A keylock 36 is disposed upon upper panel 28 as another component of said first locking means.

Basket tray 14, adapted to be removably disposed within said interior casing, is comprised of flat back panel 49, horizontal top panel 39, and opposed vertical retaining walls 37, which, at their upper extremities join top panel 39. The lower extremities of said retaining walls joint horizontal serving panel 41 whose length extends from back panel 49 to close proximity with the front portion of said exterior shell. Exteriorly directed lower tabs 42 are disposed upon the exterior surfaces 44 of both retaining walls 37. Said lower tabs contain apertures 45 which are in vertical alignment with corresponding apertures 43 in panel 39, and with apertures 52 in upper shelves 53 of said interior casing. Retaining walls 37 are adapted to hold at least ten packages of cigarettes oriented orthogonally lengthwise with respect to back panel 49. Said back panel may be equipped with means for adjusting the effective length of serving panel 41 so as to accommodate cigarette packages of varied lengths. In one embodiment, such length-adjusting means may simply be an elongated flat vertical bar adjustably secured by aligned slots in top panel 39 and serving panel 41.

Figure 3:
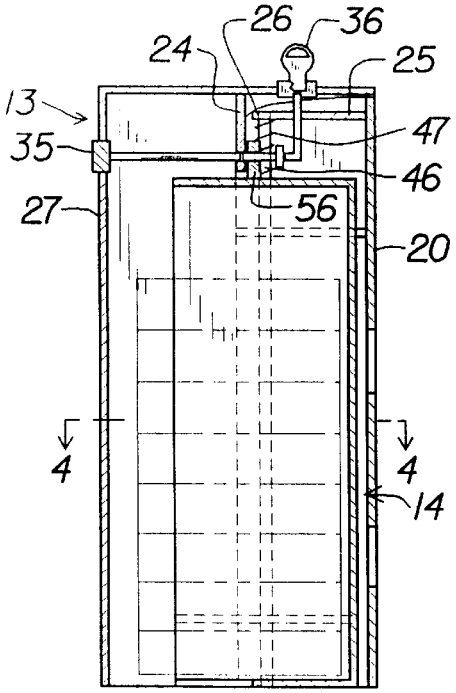
FIG. 3 is a vertical sectional side view of the embodiment of FIG. 1.
Figure 5:
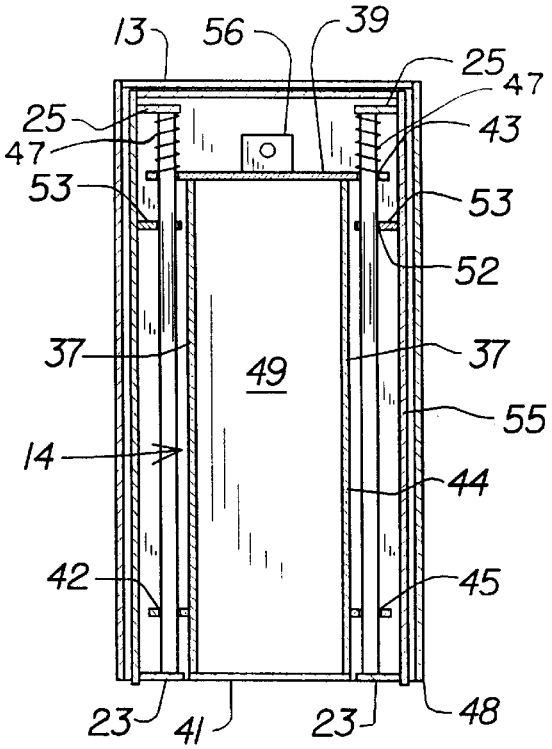
FIG. 5 is a sectional view taken in the direction of the arrows upon the line 5—5 of FIG. 4.
Figure 4:
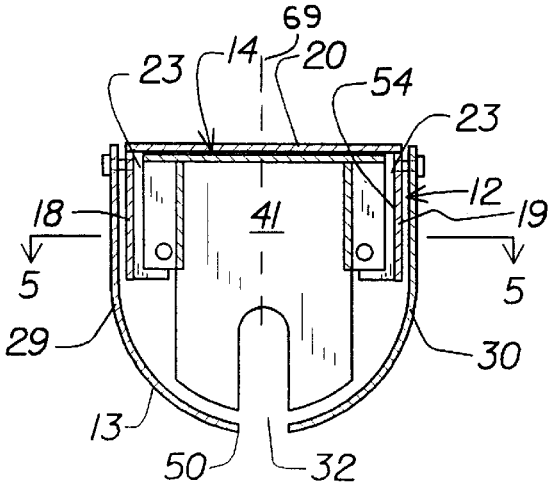
FIG. 4 is a sectional view taken in the direction of the arrows upon the line 4—4 of FIG. 3.

A control rod 46 engages each set of vertically aligned apertures 43, 45 and 52. The upper extremity of each rod 46 is secured in retaining shelf 25, and each lower extremity is secured in lower abutment shelves 23. A coil spring 47 is seated upon the upper extremity of each rod. By virtue of such interaction of components, the basket can undergo spring-driven downward movement between a dispensing lower state, as shown in FIG. 1, wherein said serving panel is disposed below the lower edge 48 of said outer shell to a sufficient extent to permit removal of a package of cigarettes from said basket tray. Said basket tray may be manually pushed upwardly to its locked upper state, as shown in FIG. 3, wherein said serving panel is spaced too close to said lower edge 48 to permit removal of a package of cigarettes.

Figure 6:
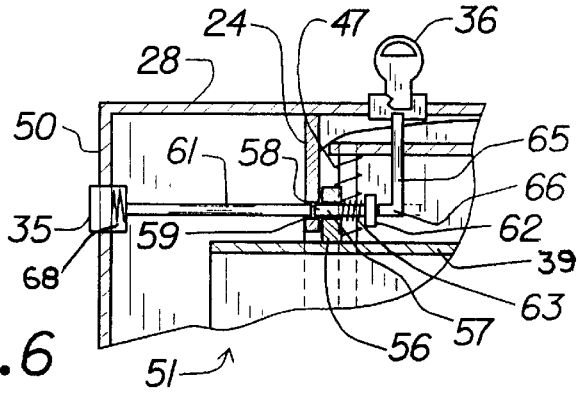
FIG. 6 is an enlarged fragmentary view of FIG. 3.

The extent of downward movement of said basket tray is limited by the impingement of top panel 39 with upper shoulders 53 of said interior casing. The extent of upward movement of said basket tray is limited by the compression of springs 47 and interaction with first locking means 51. Said first locking means, as best shown in FIG. 6 is comprised of apertured guide post 56 upwardly directed from top panel 39, and a first activation rod 57, slideably held by said post and extending to a forward extremity 58 that partially enters securing bore 59 of control panel 24. A second activation rod 61 extends from push button 35 to a rear extremity that partially enters bore 59 in facing relationship with rod 57. The rear extremity of activation rod 57 is provided with a washer 62 that retains coil spring 63 in interaction with post 56. A restoring spring 68 urges push button 35 and rod 61 to a normally outwardly directed position.

In operation, depression of button 35 causes rod 61 to push rod 57 out of securing bore 59. Such action enables paired springs 47 to drive basket tray 14 downwardly to the dispensing state of the apparatus while causing rod 57 to ride against the rear surface of control panel 24. Following removal of a cigarette package 33, manual force directed by the user upwardly against serving panel 41 causes basket tray 14 to return to its uppermost position against the urging of springs 47. Such action causes activation rod 57 to re-enter bore 59 to secure said basket tray in its locked state. Keylock 36 rotatively controls shaft 65 having distal locking elbow 66. When elbow 66 is rotated to the position shown in FIG. 6 where it is in abutment with washer 62 it is impossible to dislodge forward extremity 58 of rod 57 from bore 59, and accordingly, basket tray 14 will remain in its uppermost, locked state. When shaft 65 is rotated 180 degrees, as shown by the phantom lines in FIG. 6, elbow 66 does not impede rearward displacement of rod 57, and accordingly, depression of button 35 will achieve release of basket tray 14 to its lowermost, dispensing state.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

What is claimed is:

1. A wall-mountable apparatus for securably dispensing packages of cigarettes, said apparatus comprising:

a) a vertically elongated interior casing comprised of a top portion, opposed side panels and a flat rear panel having means for attachment to a vertical wall, b) an exterior shell comprised of a sidewall panel having a front portion, a horizontally disposed lower edge, vertically disposed rear edges, an upper panel portion, and a vertical slot in said front portion that opens onto said lower edge, said exterior shell configured to embrace said interior casing and joined thereto by way of pivot means which permit swinging movement of said exterior shell in a vertical path between an upper position which encloses said interior casing and a lower position which exposes said interior casing, c) a basket tray disposed within said interior casing and adapted to hold a vertically stacked multitude of packages of cigarettes, said basket tray being comprised of opposed vertical retaining walls, an upper extremity having a horizontally disposed abutment panel, and a lower extremity having a horizontally disposed serving panel, d) means for permitting reciprocal vertical movement of said basket tray between a dispensing lower state wherein said serving panel is disposed below the lower edge of said exterior shell to a sufficient extent to permit removal of a package of cigarettes from said basket tray, and a locked upper state wherein said serving panel is spaced too close to said lower edge to permit removal of a package of cigarettes from said basket tray, e) first locking means for preventing unauthorized movement of said basket tray to its dispensing state, and f) second locking means for securing said exterior shell in said upper position.

2. The apparatus of claim 1 wherein the attachment means of said rear panel is comprised of at least two apertures.

3. The apparatus of claim 1 which, except for said second locking means, has a center vertical plane of symmetry.

4. The apparatus of claim 1 wherein said exterior shell is of arcuate contour and said front portion is outwardly convex.

5. The apparatus of claim 1 wherein said first locking means employs a push-button associated with the sidewall panel of said exterior shell.

6. The apparatus of claim 5 wherein said first locking means is further comprised of a keylock associated with the upper panel portion of said exterior shell.

7. The apparatus of claim 1 wherein said means for permitting reciprocal vertical movement comprises paired vertically disposed control rods slidably interactive with said basket tray.

8. The apparatus of claim 7 further comprising abutment means which limit the upper and lower extents of said vertical movement.

9. The apparatus of claim 1 further comprising means associated with said basket tray for adjusting the effective length of said serving panel so as to accommodate cigarette packages of varied lengths.

10. The apparatus of claim 1 wherein said basket tray permits said packages to descend by gravity effect toward said serving panel.

* * * * *